United States Patent [19]

Jones

[11] 3,957,302

[45] May 18, 1976

[54] FURNITURE COMBINATION

[76] Inventor: Ferris E. Jones, 943 Millbury Ave., La Puente, Calif. 91746

[22] Filed: Apr. 21, 1975

[21] Appl. No.: 569,791

[52] U.S. Cl. ..... 297/126; 297/173

[51] Int. Cl.[2] ..... A47B 85/04

[58] Field of Search ..... 297/119, 126, 135, 144, 297/172–174

[56] References Cited

UNITED STATES PATENTS

| | | | |
|---|---|---|---|
| 2,820,507 | 1/1958 | Provencher | 297/126 |
| 2,845,114 | 7/1958 | Edwards | 297/123 |

FOREIGN PATENTS OR APPLICATIONS

| | | | |
|---|---|---|---|
| 602,538 | 5/1948 | United Kingdom | 297/119 |
| 645,552 | 11/1950 | United Kingdom | 297/119 |

*Primary Examiner*—James C. Mitchell
*Attorney, Agent, or Firm*—Boniard I. Brown

[57] ABSTRACT

A furniture combination including a seat and a table mounted on the seat for movement between a position of use in front of the seat and a storage position wherein the table top is disposed in an edgewise upright position at the rear of the seat. The table, when in its use position, may be adjustable toward and away from the seat to locate the table in a comfortable position for a person occupying the seat. The seat may be a chair, sofa, convertible sofa or the like.

10 Claims, 10 Drawing Figures

FURNITURE COMBINATION

BACKGROUND OF THE INVENTION

1. Field of the Invention

This invention relates generally to furniture and more particularly to a novel furniture combination including a seat and a table which is movable between use and storage positions relative to the seat.

2. Prior Art

A variety of seat and table combinations have been devised wherein the table is removable in some fashion from its normal position for use in front of the seat when the table is not being used. Examples of such furniture combinations are described in U.S. Pat. Nos. 2,555,144 and 2,635,680. These and other similar seat and table arrangements are not totally satisfactory, however, because of their complexity and lack of convenient table storage when the table is not being used. Moreover, these arrangements are restricted as to size, the type of seats which they may utilize, and purpose of table use.

SUMMARY OF THE INVENTION

This invention provides an improved furniture combination of the class described which avoids the above noted disadvantages of the existing furniture combinations of this class. The present inproved furniture combination comprises a seat, which may be a chair, sofa, or convertible sofa, and a table which is mounted on the seat for movement between a position of use in front of the seat and a storage position wherein the table top is disposed in an edgewise upright attitude at the rear of the seat. In the particular furniture combination described, the table is pivotally mounted on the seat to swing between its use and storage positions. The seat has a backrest which folds forwardly and downwardly to permit swinging of the table between its use and storage positions and the table top, when in its storage position, is situated against the rear side of the backrest with the lower edge of the top resting on a support fixed to the seat. The table is adjustable in its use position toward and away from the seat to locate the table top in a comfortable position for a person occupying the seat.

As noted above, the seat may be a chair, sofa or convertible sofa. The particular seat described is a conventional convertible sofa having a folding seat portion which is foldable and unfoldable between sofa and bed configurations. The table of the furniture combination is movable between its use and storage positions, in both of these seat configurations, such that the table may be positioned for use by a person sitting on the seat in its sofa configuration or lying on the seat in its bed configuration. The table itself is essentially a complete and separate unit which may be sold individually for installation on a conventional seat, either a chair, sofa, or convertible sofa.

DESCRIPTION OF THE PREFERRED EMBODIMENT

Figure 1:
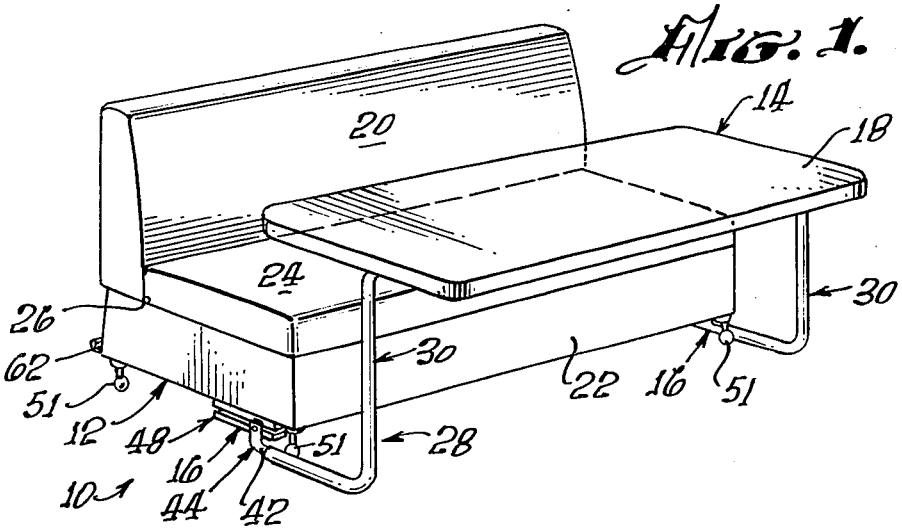
FIG. 1 is a perspective view of a furniture combination according to the invention.
Figure 2:
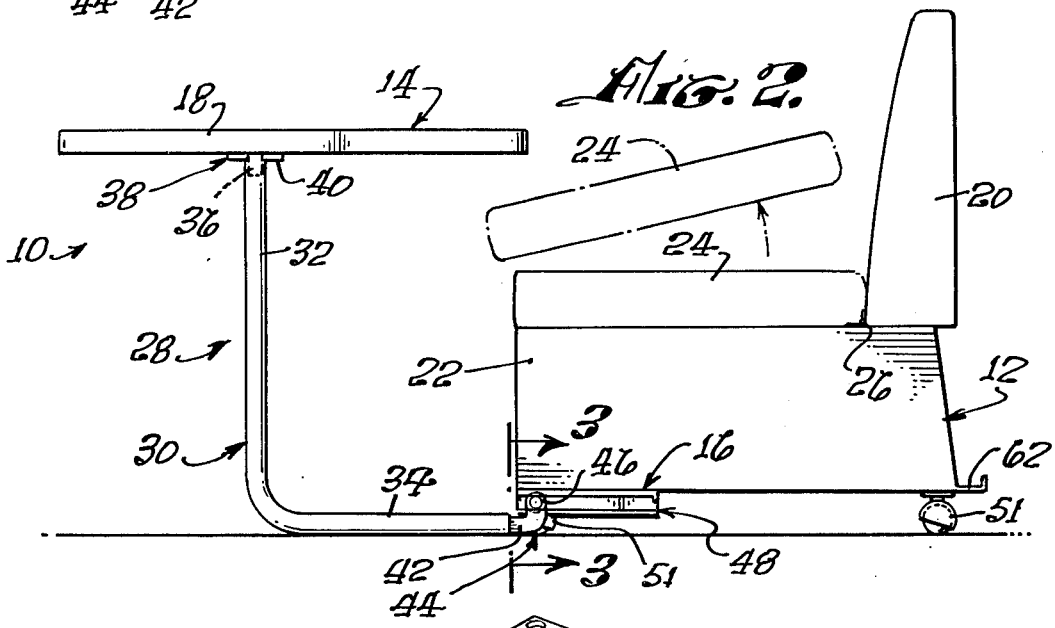
FIG. 2 is an end or side view of the furniture combination.
Figure 3:
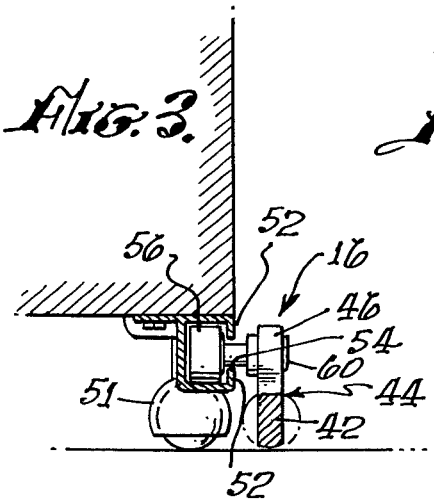
FIG. 3 is an enlarged section taken on line 3—3 in FIG. 2.
Figure 4:
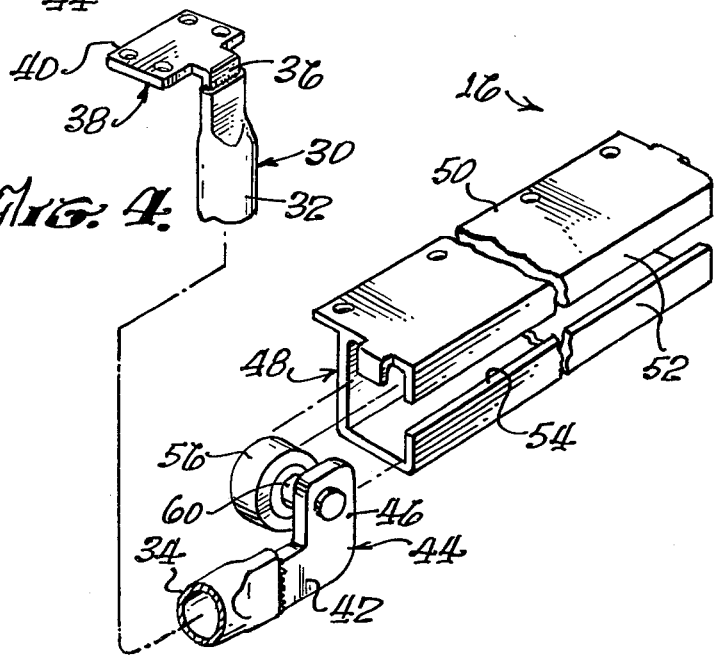
FIG. 4 is an enlarged exploded perspective view of a base member and mounting bracket for the table of the furniture combination.
Figure 5:
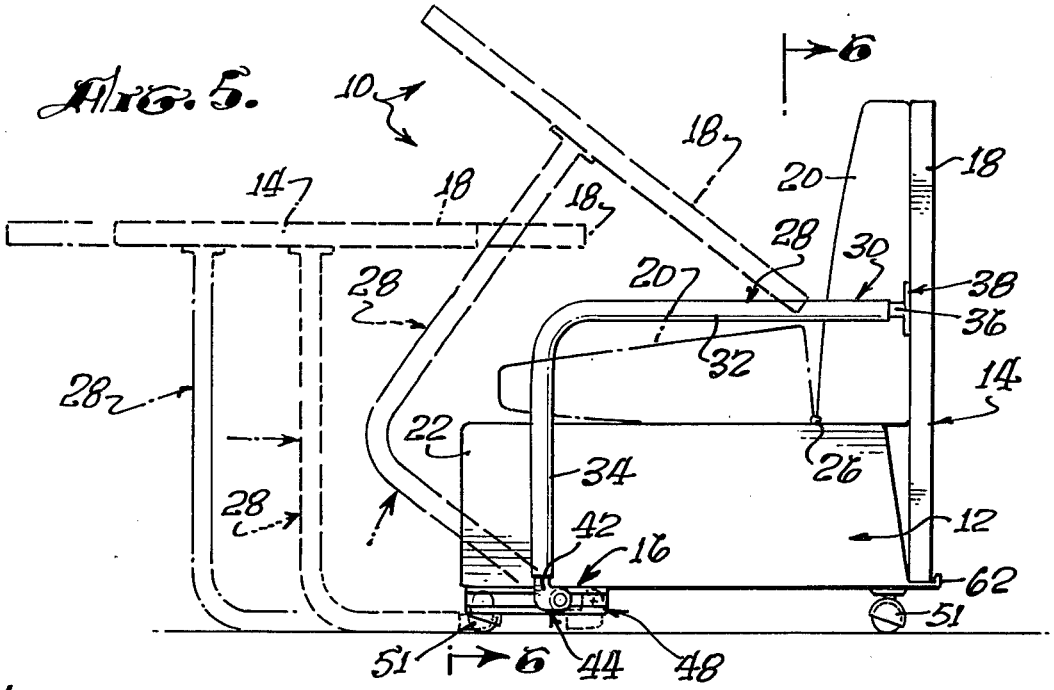
FIG. 5 is a view similar to FIG. 2 showing in solid lines the table in storage position and in broken lines an adjustment feature of the table and the method of retracting the table to its storage position.
Figure 6:
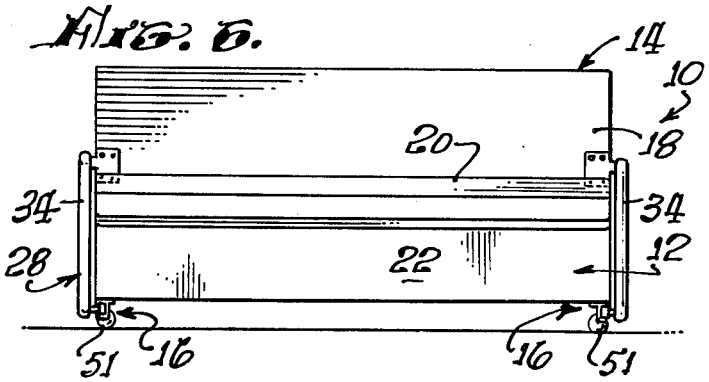
FIG. 6 is a front view on reduced scale of the furniture combination in FIG. 5, taken on line 6—6 of FIG. 5 with the back cushion folded down and the table top in its stored position.

Referring first to FIGS. 1, 2 and 5, the illustrated furniture combination 10 includes a seat 12, a table 14, and means 16 mounting the table on the seat for movement of the table between a position of use in front of the seat (FIGS. 1,2) and a storage position (FIG. 5) wherein the table top 18 is disposed in an edgewise upright attitude behind the seat. As indicated in broken lines in FIG. 5, the table top is adjustable edgewise toward and away from the seat, when the table occupies its use position, to locate the top in a comfortable position of use for a person occupying the seat. In the particular furniture embodiment illustrated, this adjustment is provided by the table mounting means 16 which is designed to accomodate adjustment of the entire table 14 toward and away from the seat.

Referring now in more detail to the drawings, the seat 12 comprises a sofa including a backrest portion 20 and a seat portion 22 having a removable cushion 24. Backrest 20 is attached by a hinge 26 to the seat portion 22, such that when the seat cushion 24 is removed, the backrest may be folded forwardly and downwardly to its lowered position shown in broken lines in FIG. 5 against the seat portion 22. As explained presently, the backrest is thus lowered to permit movement of the table 14 between its use and storage positions.

The table top 16 comprises a flat rectangular member having a length approximating or slightly greater than the length of the sofa 12. The top is supported by base means 28 including a pair of generally L-shaped base members 30 disposed in parallel planes normal to the top. Each base member 30 includes a tubular leg 32 and a tubular arm 34 rigidly joined to the lower end of and extending transversely of the leg. In this instance, the leg and arm of each base member are formed by a one-piece tube which is bent to the illustrated L-shape. The upper end of each base member leg 32 is flattened to receive and is rigidly joined to a tongue 36 of a mounting bracket 38 having a right angle mounting plate 40 which is secured by screws to the underside of the table top 18. The lower arms 34 of the two table base members 28 extend toward the same (rear) edge of the table top and are spaced to straddle the sofa 12 endwise with a small clearance between the arms and the sofa ends. The rear free ends of the arms are flattened to receive and are rigidly fixed to arms 42 of L-shaped brackets 44 having additional right angle arms 46.

In the particular furniture combination shown, the table mounting means 16 comprise slide pivot means which support the table 14 for swinging between its use and storage positions and for adjustment, in its use position, toward and away from the sofa 12, as indicated in broken lines in FIG. 5. Slide-pivot mounting means 16 comprise channel-like mounting brackets 48 having upper mounting plates 50 which seat against and are bolted to the underside of the sofa seat portion 22, along the ends and adjacent the front side of the seat portion. The sofa is supported on casters 51 which provide clearance below the sofa for the brackets. Brackets 48 are located so that they are substantially flush with or project slightly beyond the sofa ends. The outer bracket channel walls 52 have longitudinal slots 54.

Rotatably mounted on the arms 46 of the table base member brackets 44 are rollers 56 which are movable with a rolling motion through the mounting bracket channels 58. The roller axles 60 project through the channel side-wall slots 54. The axles of the two rollers 56 are coaxially aligned. It will now be understood that the slide pivot mounting means 16 support the table 14 for swinging between its use and storage positions when the sofa backrest 20 is lowered to its position of FIG. 5 and for adjustment toward and away from the sofa 12 when the table occupies its use position of FIG. 5. In this use position of the table, the arms 34 of its base members 30 extend forwardly from the sofa 12 at floor level and rest on the floor to support the table. Fixed to the rear side of the sofa seat portion 22 is a channel-like support 62 on which the lower edge of the table top 18 rests in its storage position to support the table 14 in this position. A feature of the illustrated furniture combination resides in the fact that in the storage position of the table, its base members 30 form arms at the ends of the sofa 12, as shown in solid lines in FIG. 5.

Figure 7:
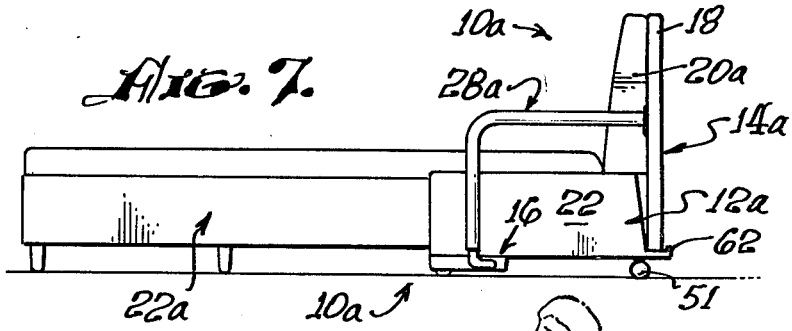
FIG. 7 illustrates a furniture combination according to the invention having a convertible sofa bed seat which may be unfolded to its illustrated sofa bed configuration and showing the table of the combination in its storage position.
Figure 8:
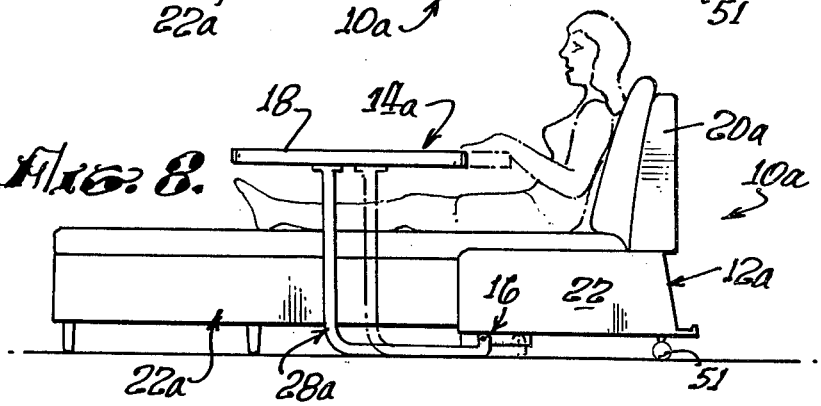
FIG. 8 is a view similar to FIG. 7 with the table in its position of use.

The particular seat 12 shown in FIGS. 1–6 is a simple sofa. FIGS. 7 and 8 illustrate a furniture combination 10*a* according to the invention which is identical to that of FIGS. 1–6 except that the seat 12*a* is a convertible sofa having a folding seat portion 22*a* which is unfoldable to its bed or divan configuration of FIGS. 7 and 8 and foldable to a seat configuration similar to that of the sofa of FIGS. 1–6. The table 14*a* of the furniture combination 10*a* is swingable between its storage position of FIG. 7 and its use position of FIG. 8 in both the seat and bed configuration of the sofa. The sofa backrest 20*a* is lowered in the same manner as the backrest of the sofa of FIGS. 1–6 when swinging the table between its positions. FIG. 8 illustrates the manner in which the table is used by a person sitting on the sofa in its bed or divan configuration.

Figure 9:
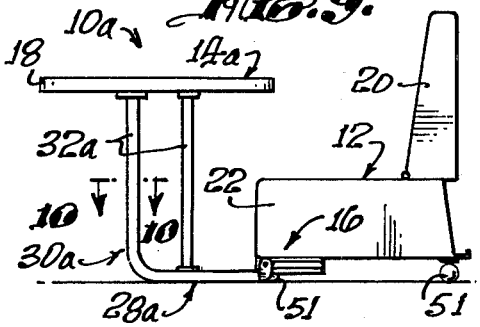
FIG. 9 is a side or end view of a furniture combination embodying a slightly modified table.
Figure 10:
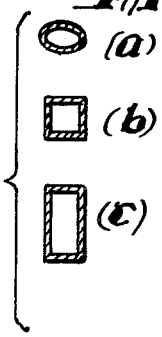
FIG. 10 is a section taken on line 10—10 of FIG. 9 showing various possible table leg cross-sections.

In some cases, it may be desirable to provide the table base members with two supporting legs to provide greater rigidity for the table top. FIG. 9 illustrates modified table base members 30*a* with such double legs 32*a*. These legs may have any of the tubular cross-sections shown in FIG. 10.

The inventor claims:

1. A furniture combination comprising:

a seat having a seat portion and backrest hinged along the rear edge of said seat portion on a fixed pivot axis relative to said seat portion for swinging forwardly and downwardly from its normal upright position to a lowered position, a table top, and means mounting said table top on said seat for swinging movement of said table top when said backrest is lowered between a position of use wherein said table top is horizontally situated in front of said seat for use by a person occupying the seat and a storage position wherein said table top is situated in an edgewise upright altitude behind said backrest and for fore and aft edgewise adjustment of said top relative to said seat in said use position of said top.

2. A furniture combination according to claim 1 including:

a support along the rear of said seat portion on which the lower edge of said table top rests in said storage position of said table top.

3. A furniture combination according to claim 1 wherein:

said table top mounting means comprises a supporting base below and mounting said table top, and slide-pivot means connecting said base and seat for swinging movement of said top and base between said use and storage positions of said top and for fore and aft adjustment of said top and base relative to said seat in said use position of said top.

4. A furniture combination according to claim 3 wherein:

said base comprises leg means secured to and extending below the normally underside of said table top and a pair of arms rigidly joined to and extending transversely of said leg means into straddling relation with said seat portion, and said slide-pivot means comprises slide-pivot connections securing said arms to said seat portion in a manner such that in said use position of said table top said base is disposed to rest on the floor forwardly of said seat portion.

5. A furniture combination according to claim 4 wherein:

in said use position of said table top, said arms extend forwardly of said seat portion at floor level for resting on the floor.

6. A furniture combination according to claim 5 including:

a support along the rear of said seat portion on which the lower edge of said table top rests in said storage position of said table top.

7. A furniture combination according to claim 4 wherein:

said slide-pivot connections comprise mounting brackets secured to the underside of said seat portion adjacent the ends and front side of the seat portion and means joining said table base arms to said brackets for swinging of said arms relative to said brackets to accommodate swinging movement of said table top and base between said use and storage positions and movement of said arms relative to said brackets in the fore and aft direction of said seat to accommodate adjustment of said table top and base toward and away from said seat when the table top occupies said use position.

8. A furniture combination according to claim 7 wherein:

said seat comprises a convertible sofa wherein said seat portion is a folding seat portion which is foldable between a sofa configuration and a bed configuration, and said table is movable between its use and storage positions in both said sofa and bed configurations of said seat portion.

9. A table for attachment to a seat comprising:

a table top, supporting base means including leg means secured to and extending below the normally underside of said table top and arm means rigidly joined to and extending transversely of said leg means, means for attaching said base means to said seat for swinging of said table between a position of use wherein said table top is horizontally situated in front of said seat for use by a person occupying the seat and a storage position wherein said table top is situated in an edgewise upright altitude behind said seat, and for adjustment of said table toward and away from said seat when the table occupies said use position, and said attaching means comprising bracket means for attachment to the underside of said seat, and slide pivot connecting means joining said arm means to said bracket means for swinging of said arm means relative to said bracket means and adjustment of said arm means along said bracket means.

10. A table according to claim 9 wherein:

said arm means comprises a pair of arms rigidly joined to the lower end of and extending transversely of said leg means for straddling said seat, said bracket means comprise a mounting bracket for each arm, and said slide pivot means comprises a slide pivot connection between each arm and its mounting bracket.

* * * * *